United States Patent [19]

Lindner

[11] Patent Number: 5,046,553

[45] Date of Patent: Sep. 10, 1991

[54] HEAT PIPE

[75] Inventor: Friedrich Lindner, Leinfelden-Echterdingen, Fed. Rep. of Germany

[73] Assignee: Deutsche Forschungsanstalt fuer Luft- und Raumfahrt e.V., Fed. Rep. of Germany

[21] Appl. No.: 575,197

[22] Filed: Aug. 28, 1990

[30] Foreign Application Priority Data

Sep. 1, 1989 [DE] Fed. Rep. of Germany ..... 3929024

[51] Int. Cl.[5] ..... F28D 15/02

[52] U.S. Cl. ..... 165/104.26; 122/366

[58] Field of Search ..... 165/104.26; 122/366

[56] References Cited

U.S. PATENT DOCUMENTS 3,435,889 4/1969 Bienert ..... 165/104.26

4,109,709 8/1978 Honda et al. ..... 165/104.26

*Primary Examiner*—Albert W. Davis, Jr.

*Attorney, Agent, or Firm*—Barry R. Lipsitz

[57] ABSTRACT

In order to improve a heat pipe comprising a housing containing a heat-transporting medium, this housing having an evaporation region and a condensation region, such that the heat pipe operates in an optimum manner with respect to its transfer capacity, it is suggested that a vapor channel be provided in the housing, that an unwettable porous structure be arranged between the vapor channel and the condensation region, this structure being impermeable for the condensate due to its pore size, and that a condensate channel be provided for guiding the condensate from the condensation region to the evaporation region.

12 Claims, 1 Drawing Sheet

HEAT PIPE

Figure 1:
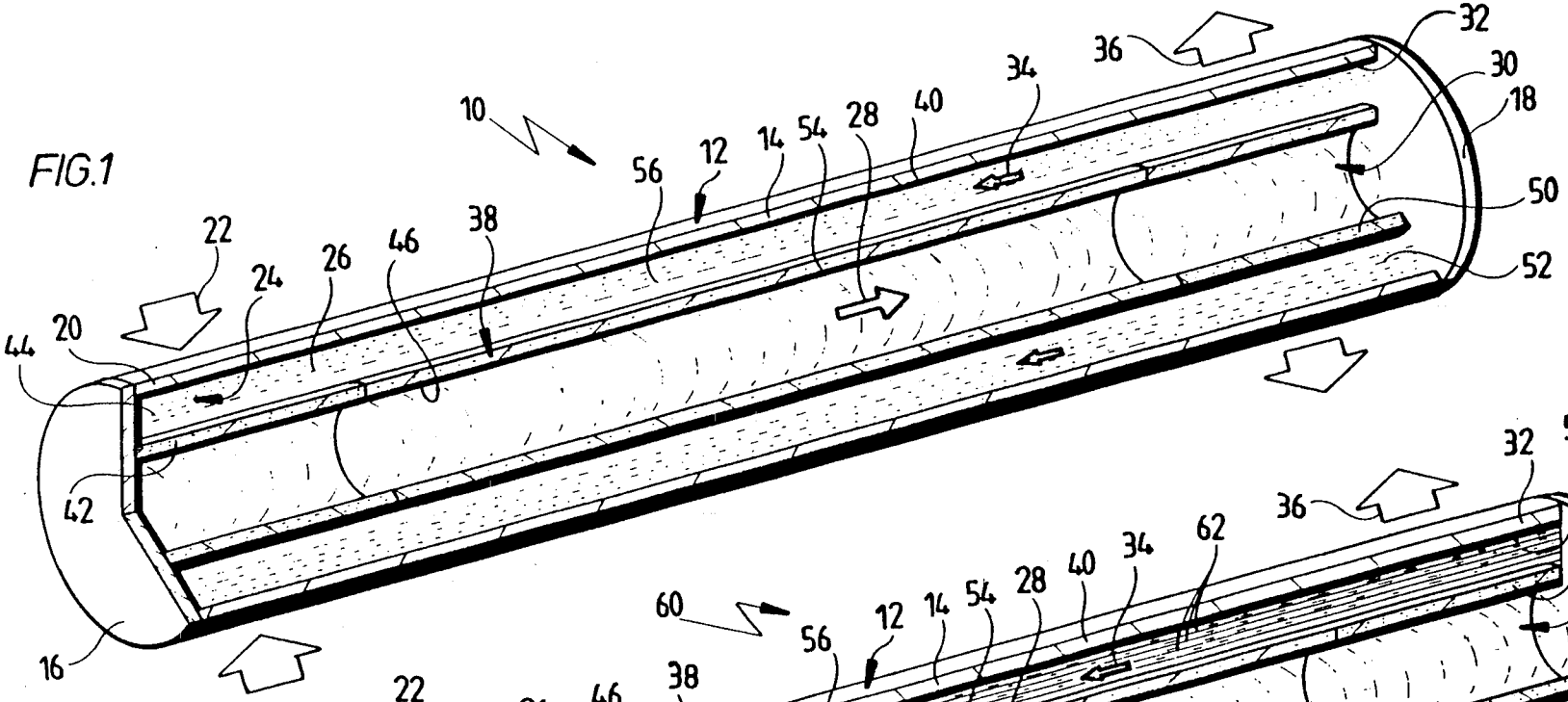

The invention relates to a heat pipe comprising a housing containing a heat-transporting medium, the housing having an evaporation region and a condensation region.

Heat pipes of this type are known.

The problem with these heat pipes is that for achieving the highest transfer capacities, in particular when the cross section of the pipes is small, the vapor flow and the condensate flow in the opposite direction thereto can be decoupled only with difficulty. This means that the condensate flow i s constantly carried along or hindered by the opposed vapor flow and, consequently, the heat pipe does not operate at an optimum with respect to its transfer capacity.

The object underlying the invention is therefore to improve a heat pipe of the generic type such that this problem no longer occurs.

This object is accomplished in accordance with the invention, for a heat pipe of the type described at the outset, in that a vapor channel is provided in the housing, that an unwettable porous structure is arranged between the vapor channel and the condensation region, this structure being impermeable for the condensate due to its pore size, and that a condensate channel is provided for guiding the condensate from the condensation region to the evaporation region.

Unwettability means, in this respect, that the surface tension of the heat-transporting medium is greater than the critical surface tension of the porous structure.

For the first time, the present invention enables the vapor flow in a heat pipe to be completely separated from the condensate flow since the unwettable porous structure prevents the condensate entering the vapor channel in the condensation region. The condensate is, on the contrary, forced to flow in the condensate channel to the evaporation region where it is vaporized.

The pressure in the condensate is also increased due to the constant formation of condensation in the condensation region and the condensate is then pressed through the condensate channel to the evaporation region due to this increasing pressure. This means, in particular, that the heat pipe operating under the influence of gravity can no longer "run dry" as long as this pressure does not exceed the capillary pressure of the unwettable structure.

In a particularly preferred embodiment of the inventive heat pipe, the condensate channel is designed as a capillary structure capable of being wetted by the condensed medium. Due to this design of the condensate channel, capillary forces are also used to improve the transport of the condensate to the evaporation region, in addition to the increase in pressure in the condensate in the condensation region which results from the inventive solution.

A particularly good mode of operation of the inventive heat pipe is achieved when the capillary structure extends right into the condensation region.

In addition, it has proven expedient for the capillary structure to be formed by the unwettable structure, the surface of which is, for this purpose, coated with wettable materials. This allows the desired capillary structure and the unwettable porous structure to be formed therefrom in a simple manner by producing a single carrier structure.

Furthermore, it is advantageous for an unwettable porous structure to be provided between the evaporation region and the vapor channel, this structure being impermeable for the condensed medium due to its pore size.

The simplest solution is for the unwettable porous structure to line the entire housing on the inside.

A solution, in which the unwettable porous structure is part of a housing insert, has proven to be constructionally advantageous. In this way, the condensate flow and vapor flow are clearly separated both in the condensation region and in the evaporation region.

It is expedient for the capillary structure of the inventive heat pipe to extend right into the evaporation region.

In this respect, it is favourable for the housing insert to include the vapor channel, for example in the form of bores or channels inserted into the housing insert.

In addition, it is advantageous for the housing insert to include the condensate channel and this can also be inserted into the housing insert in the form of, for example, channels.

It is more advantageous for the housing insert to include the capillary structure as well, i.e. for the housing insert to partially form the capillary structure.

A particularly economical solution has been shown to result when the housing insert is produced from the unwettable porous structure and transformed in a peripheral region into a wettable capillary structure, for example by surface coating the unwettable porous structure with a material capable of being wetted by the condensate.

In a particularly preferred solution from a constructional point of view, the housing is a hollow cylinder and the housing insert is a hollow part insertable therein and having an unwettable porous structure arranged in the form of a cylinder casing.

In all the embodiments so far described, nothing has been said concerning the material structure of the unwettable porous structure. It is, for example, advantageous for the unwettable porous structure to be a foam material, a fabric material or a felt material.

In addition, nothing has been said in all the embodiments described thus far concerning the material, from which the unwettable porous structure is advantageously produced. For example, embodiments provide for the unwettable porous structure to be formed from graphite as unwettable material for metals or alkali halides serving as heat-transporting medium as well as from Teflon as unwettable material for water or ammonia serving as heat-transporting medium.

Furthermore, nothing has been said in conjunction with the embodiments described thus far about the pore size of the porous structure. The pore size is determined by the surface tension of the condensate and selected such that it is smaller than the pore size through which the condensate would still pass at the prevailing pressures.

Figure 2:
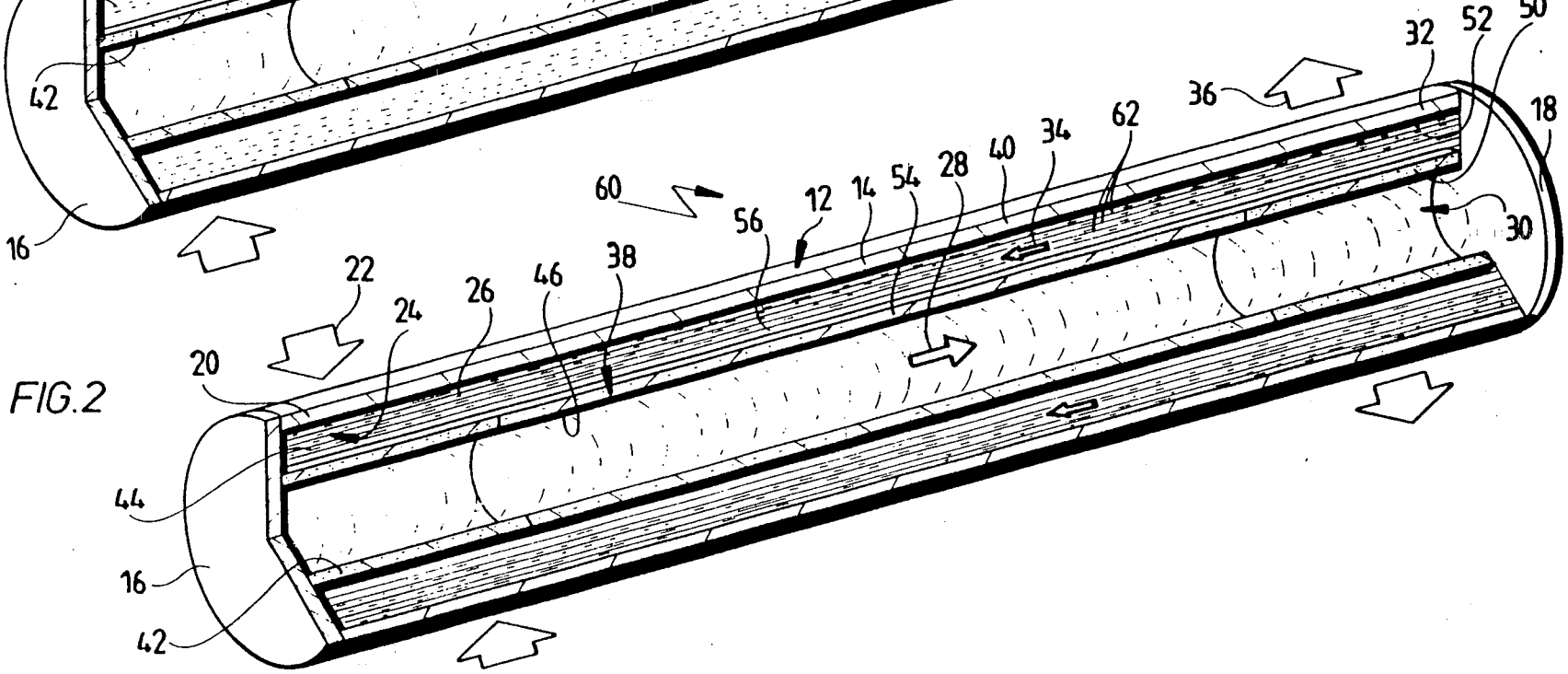

Additional features and advantages of the invention are the subject of the following description as well as the drawings of one embodiment. In these drawings, FIG. 1 is a perspective illustration of a first embodiment of a heat pipe cut open in the longitudinal direction and FIG. 2 is a perspective illustration of a second embodiment of a heat pipe cut open in the longitudinal direction.

A first embodiment of an inventive heat pipe, designated as a whole as 10, comprises a housing 12 which is designed as a cylindrical pipe 14 closed by end covers 16 and 18.

A heat-transporting medium is arranged in this cylindrical pipe 14. This medium is present in the cylindrical pipe either as a condensate or as a vapor. If a heat flow 22 is fed to a wall section 20 of the cylindrical pipe 14, an evaporation region 24 is formed in the cylindrical pipe 14, in which the condensate 26 coming into contact with the wall section 20 vaporizes and flows as a vapor flow 28 to a condensation region 30 in the pipe 14, in which it condenses when contacting a wall section 32 of the cylindrical pipe and, from there, returns to the evaporation region 24 as a condensate flow 34. A heat flow 36 can therefore be drawn off from the wall section 32.

For separating the vapor flow 28 from the condensate flow 34 in the cylindrical pipe, a housing insert 38 is provided in this pipe and this insert is also designed as a cylindrical tube and extends from one cover 16 to the other cover 18. This housing insert is designed in the evaporation region as an unwettable porous structure 42 which, due to its porosity, allows the vapor flow 28 forming in the evaporation region 24 to pass from an intermediate chamber 44 between the housing insert 38 and the wall section 20 into its axial hollow channel 46 so that the vapor flow 28 can expand along the axial hollow channel 46 and reach the condensation region 30. The axial hollow channel 46 therefore serves as a channel for the vapor flow 28.

The fact that the unwettable porous structure is impermeable for the condensate 26 ensures that this has to remain in the intermediate chamber 44 until it has vaporized.

In the condensation region 30 the housing insert 38 is also designed as an unwettable porous structure 50 which allows the vapor flow 28 to pass from the axial hollow channel 46 into an intermediate chamber 52 arranged between the housing insert 38 and the wall section 32. This structure does, however, prevent passage of the condensate, and, with it, the condensate flow 34, into the axial hollow channel 46 in view of the pore size of the unwettable porous structure 50 which is adapted to the surface tension of the heat-transporting medium.

The housing insert 38 may be of any optional design between the unwettable porous structure 42 in the evaporation region 24 and the unwettable porous structure 50 in the condensation region 30. For example, it is possible in a simplified embodiment for the housing insert 38 to be designed as a closed wall 54 so that a condensate channel results between the wall 54 and the outer walls 40 of the cylindrical pipe 14 due to the intermediate chamber 56.

However, in order to be able to place the evaporation region 24 and the condensation region 30 optionally in the axial direction of the cylindrical pipe 14, it is advantageous for the housing insert 38, and, with it, the wall 54, as well, to be designed as an unwettable porous structure which allows the vapor flow 28 of the heat-transporting medium to pass through but not the condensate flow 34.

The inventive design of the housing insert 38 therefore ensures that the vapor flow 28 is completely separated from the condensate flow 34 in the first embodiment 10 of the inventive heat pipe and that the vapor flow 28 and the condensate flow 34 do not hinder one another.

When a heat pipe of this type is operated in the field of gravity and the condensation region 30 lies lower than the evaporation region 24, an increasing pressure will result from the increasing condensate formation in the intermediate chamber 52. This pressure is responsible for the condensate flow 34 to the evaporation region 24 contrary to the direction of the force of gravity and therefore prevents the heat pipe from "running dry" in the evaporation region since the condensate flow 34 to the evaporation region 24 is maintained despite the effect of the force of gravity.

In a second, improved embodiment of the inventive heat pipe, designated as a whole as 60, parts which are identical to those of the first embodiment have been given the same reference numerals and so reference can be made to the remarks concerning the first embodiment with respect to their description.

In contrast to the first embodiment, the intermediate chamber 56 at least is filled with a capillary structure 62 which leads to a capillary effect acting in the axial direction of the cylindrical pipe 14 and therefore assists the condensate flow 34 from the intermediate chamber 52 to the intermediate chamber 44 due to the capillary action.

It is particularly favourable in this second embodiment to have the intermediate chamber 52 and the intermediate chamber 44 also filled with the capillary structure 62 so that the capillary effect occurs over the entire axial length of the heat pipe 60.

The inventive capillary structure may, according to a preferred embodiment of the invention, be produced by forming the housing insert 38 designed as a pipe from the unwettable porous structure and having the housing insert reach as far as the outer walls 40 of the cylindrical pipe, i.e. no macroscopic intermediate chambers 44, 52 and 56 result between the housing insert 38 and the outer walls. The wettable porous structure is produced by coating the surface of the unwettable structure with a material which is capable of being surface-wetted by the heat-transporting medium. The capillary structure 62 is therefore formed in a partial section of the housing insert 38 facing the outer walls 40 due to the surface now wettable by the condensed medium. That part of the housing insert 38 made of the unwettable porous structure, which is not surface coated, and located radially inwards with respect to the capillary structure now has the effect, in the described embodiment, which was originally intended for this structure.

The materials listed in the following Table can be used as unwettable porous structure for the relevant heat-transporting medium.

TABLE

| Heat-transporting Medium | Unwettable Porous Structure |
|---|---|
| Hg | Glass |
| Hg | Graphite (C) |
| $H_2O$ | Teflon |
| $H_2O$ | Graphite (C) |
| $H_2O$ | Polyethylene |
| $NH_3$ | Teflon |
| $NH_3$ | Polytetrafluoroethylene |
| $NH_3$ | Polyethylene |
| LiF | Graphite (C) |
| Ag | Graphite (C) |
| NaF | Graphite (C) |
| Al | Graphite (C) |
| $H_2O$ | Polyvinyl fluoride |
| $NH_3$ | Polyvinyl fluoride |
| $H_2O$ | Polyethylene terephthalate |

TABLE-continued

| Heat-transporting Medium | Unwettable Porous Structure |
|---|---|
| $NH_3$ | Polyethylene terephthalate |

It is, for example, conceivable to metallize the surface of the respective structure as coating for converting the unwettable porous structure into a capillary structure capable of being wetted by the condensed heat-transporting medium.

The present disclosure relates to the subject matter disclosed in German application No. P 39 29 024.7-16 of Sep. 1, 1989, the entire specification of which is incorporated herein by reference.

What is claimed is:

1. A heat pipe comprising:

a housing containing a heat transporting medium;

an evaporation region in said housing;

a condensation region in said housing;

a vapor channel for carrying vapor from said evaporation region to said condensation region;

a condensate channel for guiding condensate from said condensation region to said evaporation region; and an unwettable porous structure arranged between said vapor channel and said condensate channel in said condensation region, said structure having a pore size that renders it impermeable for the condensate to preclude condensate from entering said vapor channel.

2. Heat pipe as defined in claim 1, characterized in that said condensate channel is designed as a capillary structure capable of being wetted by the condensed medium.

3. Heat pipe as defined in claim 2, characterized in that said capillary structure extends into said condensation region.

4. Heat pipe as defined in claim 2, characterized in that said capillary structure extends into said evaporation region.

5. Heat pipe as defined in claim 2, characterized in that said capillary structure is formed by the unwettable structure surface-coated with wettable materials.

6. Heat pipe as defined in claim 1, characterized in that an unwettable porous structure is provided between said evaporation region and said vapor channel, said structure being impermeable for said condensed medium due to its pore size.

7. Heat pipe as defined in claim 1, characterized in that said unwettable porous structure is part of a housing insert.

8. Heat pipe as defined in claim 7, characterized in that said housing insert includes said vapor channel.

9. Heat pipe as defined in claim 7, characterized in that said housing insert includes said condensate channel.

10. Heat pipe as defined in claim 9, characterized in that said housing insert includes said capillary structure.

11. Heat pipe as defined in claim 7, characterized in that said housing is a hollow cylinder and said housing insert is a hollow part insertable therein and having an unwettable porous structure arranged in the form of a cylinder casing.

12. Heat pipe as defined in claim 1, characterized in that said unwettable porous structure is a foam material or a fabric material or a felt material.

* * * * *